US008580090B2

(12) United States Patent
Gorer et al.

(10) Patent No.: US 8,580,090 B2
(45) Date of Patent: Nov. 12, 2013

(54) COMBINATORIAL ELECTROCHEMICAL DEPOSITION

(75) Inventors: Alexander Gorer, Los Gatos, CA (US); Zhi-Wen Sun, San Jose, CA (US)

(73) Assignee: Intermolecular, Inc., San Jose, CA (US)

( * ) Notice: Subject to any disclaimer, the term of this patent is extended or adjusted under 35 U.S.C. 154(b) by 0 days.

(21) Appl. No.: 13/332,760

(22) Filed: Dec. 21, 2011

(65) Prior Publication Data

US 2012/0090987 A1 Apr. 19, 2012

Related U.S. Application Data

(62) Division of application No. 12/183,299, filed on Jul. 31, 2008.

(60) Provisional application No. 60/953,427, filed on Aug. 1, 2007.

(51) Int. Cl.
*C25D 17/00* (2006.01)
*C40B 60/00* (2006.01)

(52) U.S. Cl.
USPC ..... 204/267; 205/81; 506/33

(58) Field of Classification Search
USPC ..... 205/81
See application file for complete search history.

(56) References Cited

U.S. PATENT DOCUMENTS

| | | | | |
|---|---|---|---|---|
| 6,225,012 | B1 * | 5/2001 | Nishi et al. | 430/22 |
| 6,413,388 | B1 * | 7/2002 | Uzoh et al. | 204/224 R |
| 2002/0008034 | A1 * | 1/2002 | Chen et al. | 205/82 |
| 2002/0192664 | A1 * | 12/2002 | Nygren et al. | 435/6 |
| 2004/0140203 | A1 * | 7/2004 | Burkhart et al. | 204/297.01 |
| 2004/0178058 | A1 * | 9/2004 | Chen et al. | 204/212 |
| 2006/0207885 | A1 * | 9/2006 | Basol | 205/137 |
| 2006/0292845 | A1 * | 12/2006 | Chiang et al. | 438/597 |
| 2007/0029189 | A1 * | 2/2007 | Zach | 204/228.3 |

* cited by examiner

*Primary Examiner* — Jonathan Johnson
*Assistant Examiner* — Bryan D. Ripa

(57) ABSTRACT

Combinatorial electrochemical deposition is described, including dividing a wafer into a plurality of substrates for combinatorial processing, immersing the plurality of substrates at least partially into a plurality of cells, within one integrated tool, including electrolytes, the cells also including electrodes immersed in the electrolytes, depositing layers on the substrates by applying potentials across the substrates and the electrodes, and varying characteristics of the depositing to perform the combinatorial processing.

10 Claims, 6 Drawing Sheets

COMBINATORIAL ELECTROCHEMICAL DEPOSITION

PRIORITY CLAIM TO PROVISIONAL APPLICATION

This application is a Divisional Application of U.S. patent application Ser. No. 12/183,299 entitled "Combinatorial Electrochemical Deposition" filed on Jul. 31, 2008 which claims priority under the provisions of 35 U.S.C. §119 for the present application based upon U.S. Provisional Application No. 60/953,427 filed on Aug. 1, 2007, both of which are incorporated herein by reference.

FIELD OF THE INVENTION

The present invention relates generally to combinatorial processing. More specifically, combinatorial electrochemical deposition is disclosed.

BACKGROUND OF THE INVENTION

Electrochemical deposition (i.e., electrochemical plating or electroplating) uses electrical current to coat a conductive object with a layer of metal. The surface to be plated (i.e., the working electrode) is submersed in an electrolyte containing salts of the metal to be deposited. The surface to be plated may connected to a current source in such as way as to be a cathode, for example. Another electrode (i.e., the counter electrode), which is connected to the current source so as to be the anode, for example, is also immersed in the electrolyte to create an electrical path. For example, to deposit a layer of copper on a conductive wafer, the wafer may be submersed into an electrolyte containing copper salts along with a sacrificial copper conductive electrode. A current source is attached to the wafer and the electrode to perform the electrochemical deposition.

After the wafer is submersed in the electrolyte, a potential is applied between the wafer and the electrode. For example, the wafer may be the cathode, while the other electrode is a anode. Current flows between the anode and the cathode, causing metal from the electrolyte to deposit on the cathode (the wafer). The metal at the anode is oxidized from the zero valence state to form cations with a positive charge. The cations associate with anions in the solution. The cations are reduced at the cathode (i.e., the wafer) to deposit in the metallic, zero valence state. For example, using a copper counter electrode in a sulfuric acid electrolyte, copper is oxidized at the counter electrode to a $Cu^{2+}$ cation. The $Cu^{2+}$ cations associate with $SO_4^{2-}$ anions in the electrolyte to form copper sulfate ($CuSO_4$). At the cathode, the $Cu^{2+}$ cations are reduced to metallic copper. In this way, a layer of copper can be deposited on the wafer. The thickness, consistency, density, resistivity, and other characteristics of the deposited copper layer depend on the process conditions used to deposit the layer. Devices for evaluating several electrochemical reactions have been implemented. These devices include a working electrode that is a cylindrical metal rod. Several of these working electrodes are plated simultaneously for later evaluation.

Thus, what are needed are new techniques for testing various electrochemical deposition processing conditions for semiconductor processing.

BRIEF DESCRIPTION OF THE DRAWINGS

Various embodiments of the invention are disclosed in the following detailed description and the accompanying drawings.

DETAILED DESCRIPTION

Figure 1:
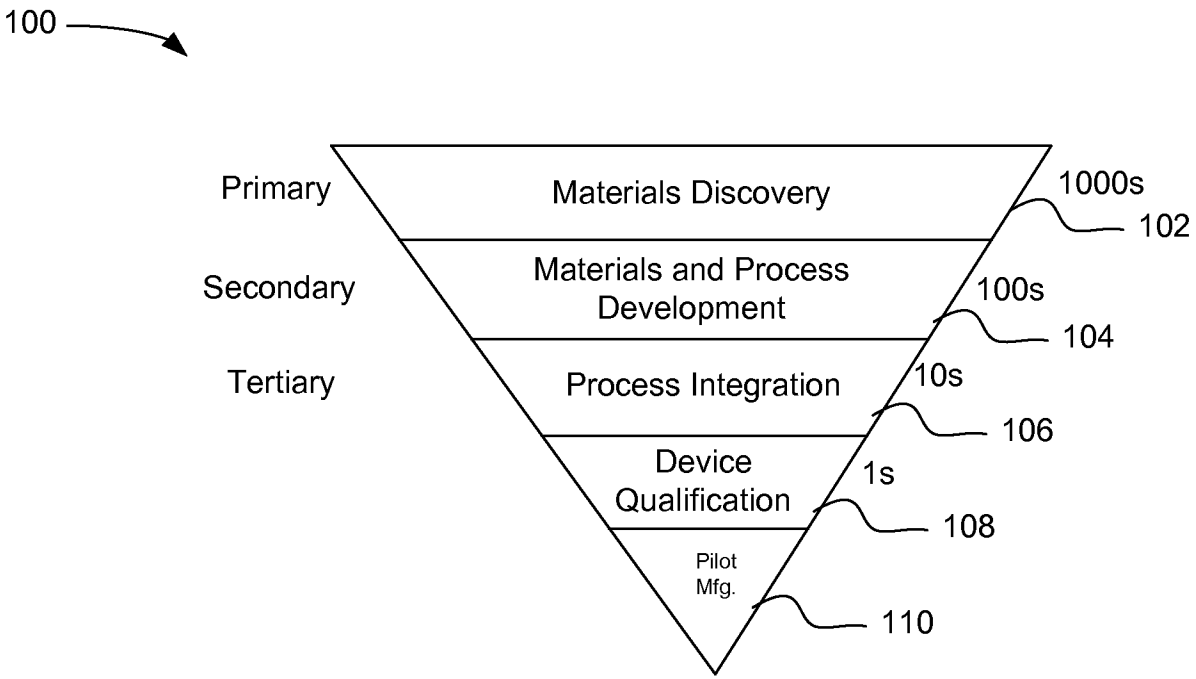
FIG. 1 illustrates a schematic diagram for implementing combinatorial processing.

A detailed description of one or more embodiments is provided below along with accompanying figures. The detailed description is provided in connection with such embodiments, but is not limited to any particular example. The scope is limited only by the claims and numerous alternatives, modifications, and equivalents are encompassed. Numerous specific details are set forth in the following description in order to provide a thorough understanding. These details are provided for the purpose of example and the described techniques may be practiced according to the claims without some or all of these specific details. For the purpose of clarity, technical material that is known in the technical fields related to the embodiments has not been described in detail to avoid unnecessarily obscuring the description.

According to various embodiments, combinatorial electrochemical deposition is described. In some embodiments, a substrate (effectively a working electrode), such as a portion of a wafer (e.g., a coupon), and a anode (a counter electrode), are at least partially submersed in an electrolyte containing salts of the metal to be deposited. The electrolyte may be contained by a cell that is one of several cells used for combinatorial electrochemical deposition. Other substrates are also deposited into other cells containing electrolyte solutions. Various of the process conditions used to deposit metal layers on the substrates can be varied. For example, temperature, the composition of the electrolyte solution, current, voltage, current density, rotation speed, deposition pretreatment, initial potential, pulse profile (e.g., waveform) and other conditions can be varied between the substrates. The resulting deposited layers can be compared to determine which process conditions produce desirable results. Certain process conditions can then be selected to be performed on a full size wafer or in manufacturing.

Combinatorial Processing

Combinatorial processing may include any processing (e.g., semiconductor processing) that varies the processing conditions across two or more substrates. As used herein, a substrate may be, for example, a portion of a semiconductor wafer, other semiconductor substrate, or solar photovoltaic circuitry. The term "substrate" includes a coupon, which is a diced portion of a wafer, or any other device on which semiconductor processes are performed, but does not include full wafers. The coupon or substrate may contain one die, multiple die (connected or not through the scribe), or portion of die with useable test structures. In some embodiments, multiple coupons, or die can be diced from a single wafer and processed combinatorially.

A process may be performed on each of the substrates. For example, a first substrate is electrochemically plated using a first current and a second substrate is electrochemically plated using a second current. The results (e.g., the measured characteristics of the deposited layer) of the two plating processes are evaluated, and none, one, or both of the currents may be selected as suitable candidates for larger scale processing (e.g., further combinatorial processing or deposition on a full wafer).

In some electrochemical processes, it is necessary to maintain a potential on the substrate before immersing the substrate into the plating solution to prevent premature reaction between the plating solution and the substrate. This potential is another combinatorial variable that can be evaluated using the embodiments described herein.

FIG. 1 illustrates a schematic diagram 100 for implementing combinatorial processing. The schematic diagram 100 illustrates that the relative number of combinatorial processes run with a group of substrates decreases as certain materials and/or processes are selected. Generally, combinatorial processing includes performing a large number of processes during a first screen, selecting promising candidates from those processes, performing the selected processing during a second screen, selecting promising candidates from the second screen, and so on. In addition, feedback from later stages to earlier stages can be used to refine the success criteria and provide better screening results.

For example, thousands of materials are evaluated during a materials discovery stage 102. These materials can be deposited using electrochemical processes, for example. Materials discovery stage 102 is also known as a primary screening stage performed using primary screening techniques. Primary screening techniques may include dividing wafers into coupons and depositing materials using varied processes. The materials are then evaluated, and promising candidates are advanced to the secondary screen, or materials and process development stage 104. Evaluation of the materials is performed using metrology tools such as electronic testers and imaging tools (i.e., microscopes).

The materials and process development stage 104 may evaluate hundreds of materials (i.e., a magnitude smaller than the primary stage) and may focus on the processes and parameters of those processes (e.g., voltage, duration, etc.) used to deposit or develop those materials. Promising materials and processes are again selected, and advanced to the tertiary screen or process integration stage 106, where tens of materials and/or processes and combinations are evaluated. The tertiary screen or process integration stage 106 may focus on integrating the selected processes and materials with other processes and materials.

The most promising materials and processes from the tertiary screen are advanced to device qualification 108. In device qualification, the materials and processes selected are evaluated for high volume manufacturing, which normally is conducted on full wafers within production tools, but need not be conducted in such a manner. The results are evaluated to determine the efficacy of the selected materials and processes. If successful, the use of the screened materials and processes can proceed to manufacturing 110.

Combinatorial electrochemical deposition may be used during any of the screening levels described above, but in some embodiments may be particularly useful with the process integration (i.e., tertiary) stage. In one example, materials for use in semiconductor processing can be discovered during primary and secondary screens, and electrochemical deposition can be combinatorially performed on those materials during a tertiary screen to determine useful process conditions for electrochemical deposition of materials that have been selected in the primary and secondary screens.

The schematic diagram 100 is an example of various techniques that may be used to evaluate and select materials and processes for the development of semiconductor devices. The descriptions of primary, secondary, etc. screening and the various stages 102-110 are arbitrary and the stages may overlap, occur out of sequence, be described and be performed in many other ways.

In other embodiments, combinatorial electrochemical deposition can be performed independent of the hierarchy described in the schematic diagram 100. For example, various electrolytes can be tested on portions of a wafer to determine which electrolyte(s) produce the best deposited layer.

Electrochemical Deposition Cells

Figure 2A:
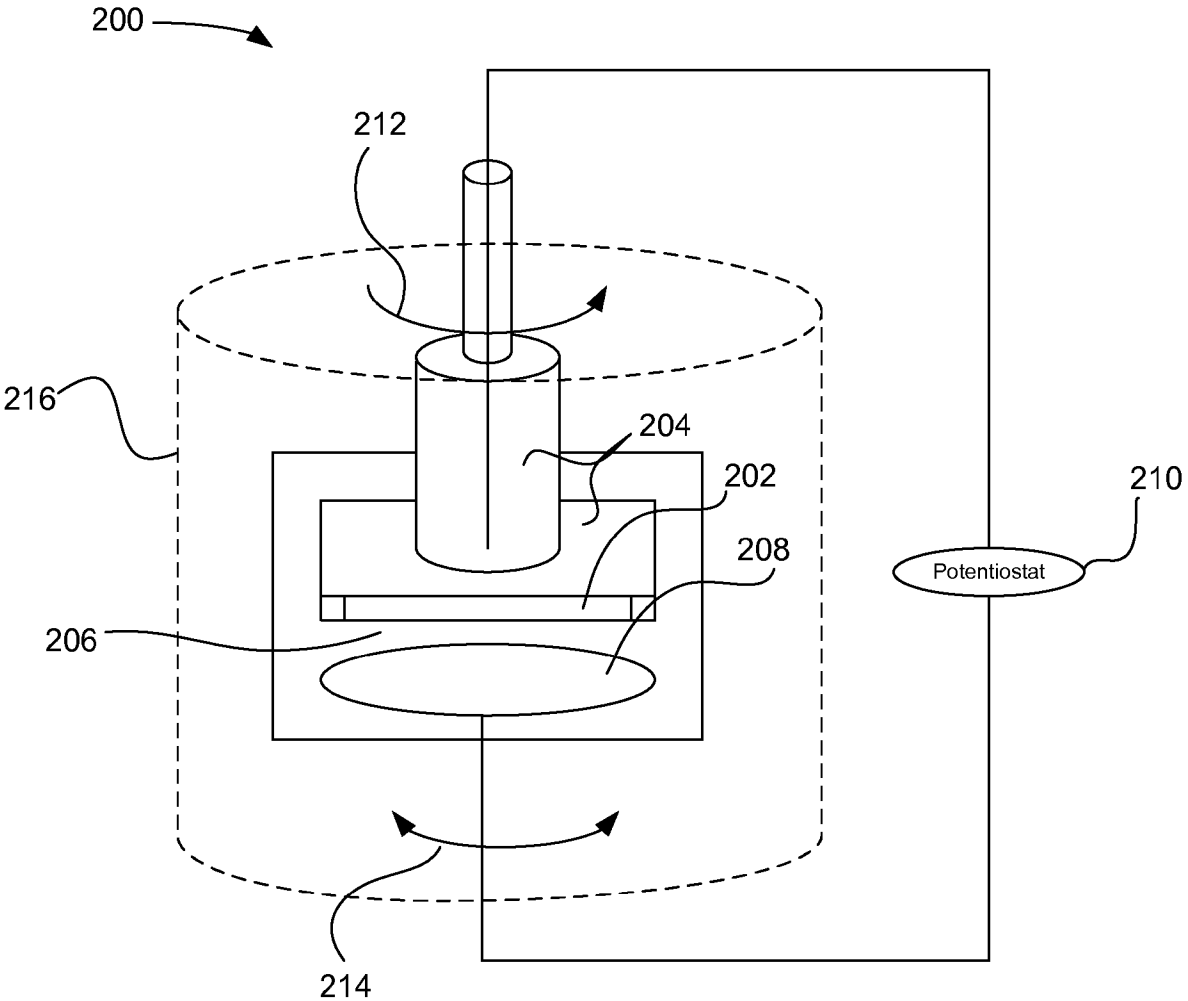
FIG. 2A illustrates a cell for performing combinatorial electrochemical deposition.

FIG. 2A illustrates a cell for performing combinatorial electrochemical deposition. The cell 200 is used to deposit a metal layer on a conductive portion of a substrate 202 using electrochemical deposition. The substrate 202 may be a portion of wafer, such as a coupon. The substrate 202 may be a patterned or a blanket substrate, and may include semiconductor devices or one or more dies. Although the substrate 202 is shown having a square shape, it is understood that the substrate 202 may be circular or have any other shape. The substrate 202 is attached to a die mount 204 that holds, rotates, and provides current to the substrate 202. The die mount 204 is shown in more detail in FIG. 3.

As shown here the substrate 202 is held in an inverted position. In other embodiments, the substrate 202 may be positioned anywhere within the cell 200, and cell 200 may have any orientation. In other embodiments, the substrate can be held at any angle, and the substrate can be connected to the potentiostat in any suitable fashion. The substrate 202 may further be one of several substrates processed combinatorially (see FIG. 2B).

Electrochemical deposition is performed by at least partially submersing the substrate 202 (i.e., a working electrode or the cathode) into an electrolyte 206 that contains salts of the metal (e.g., copper, nickel) to be deposited on the substrate 202. The substrate 202 is disposed opposite a anode 208 (i.e., a counter electrode). The anode 208 may be a sacrificial copper anode, for example. In other embodiments, the substrate 202 may be the anode, and a counter electrode may be the cathode. Additionally, a reference electrode may also be used.

A potentiostat 210 is attached to the substrate 202 and the anode 208 in such a way as to form a circuit through the electrolyte 206. The potentiostat 210 is used to provide variable currents and voltages to perform the electrochemical deposition. For combinatorial processing using multiple reaction chambers, as described in FIG. 2B, a multi-channel potentiostat may be used to provide additional control and parallel processing in each reaction chamber. A multi-channel potentiostat can, for example, vary the voltage, current, etc. provided to each reaction chamber, thereby varying the processing parameters and combinatorially processing various wafers or wafer fragments.

The substrate 202 may also be rotated 212 to enable the electrochemical deposition. For example, the substrate 202 may be rotated 212 to agitate the electrolyte 206, which may be necessary for the electrochemical deposition. In other embodiments, the anode 208 can also be rotatable 214. The anode 208 can rotate 214 in the same direction, or counter to the substrate 202. If the anode 208 rotates 214 counter to the substrate 202, the electrolyte 206 may be held between the substrate 202 and the anode 208 by capillary forces. In this embodiment, it may not be necessary to have a cell wall 216 to contain the electrolyte 206, since the forces created by the rotation 212 and counterrotation 214 of the substrate 202 and anode 208 are sufficient to retain the electrolyte 206 within the space between the substrate 202 and the anode 208.

Figure 2B:
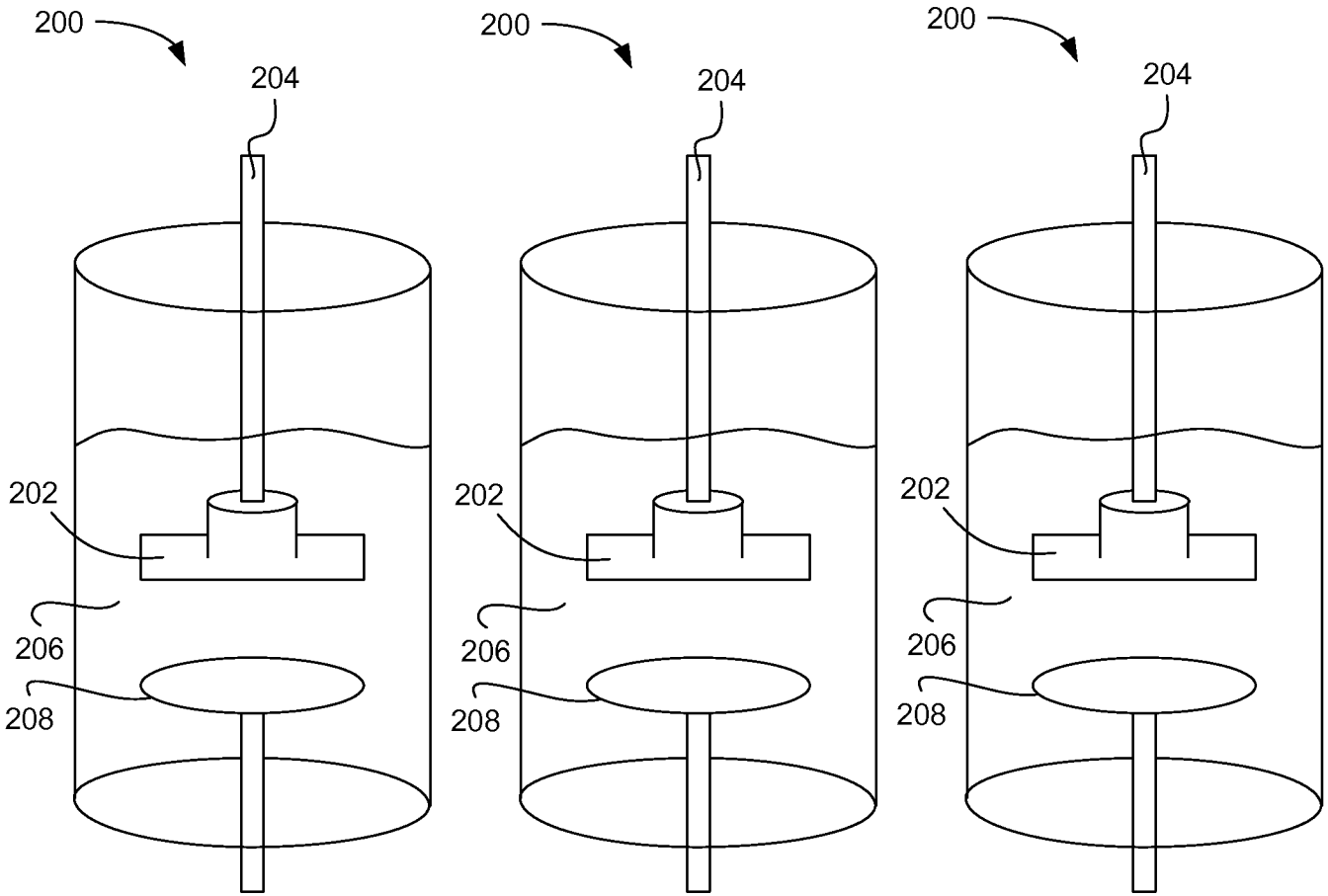
FIG. 2B illustrates several cells used in combinatorial electrochemical deposition.

FIG. 2B illustrates several cells 200 used in combinatorial electrochemical deposition. Various combinatorial processes can be performed in serial, parallel, or serial-parallel fashion. For example, in each of the cells 200, a different electrolyte may be used to evaluate the efficacy of various electrolyte compositions. Alternatively, other variables, such as the substrate composition, voltage, current, current density, rotational speed and direction of the substrate 202 and/or the anode 208, duration of plating, and temperature, distance between electrodes can be varied to perform several experiments in a rapid fashion. The results of these experiments can be compared to determine the efficacies of various electrochemical deposition processing conditions.

In one embodiment, a combinatorial electrochemical plating tool can include a plurality of die mounts, each configured to hold a substrate that may be a portion of a wafer. The tool further includes a plurality of electrochemical deposition cells, each of which holds an electrolyte. The die mounts can be at least partially submerged into the electrolyte of the cells. The cells each further include a counter electrode. A multichannel potentiostat is connected to the tool and each of the cells to perform combinatorial electroplating on each of the substrates.

As an example of combinatorial processing, three different electrolytes 206 can be evaluated. Each different electrolyte is introduced into a cell and the other processing parameters are kept constant across the three cells. The electroplating is performed, and the results can be characterized and evaluated to determine the efficacy of each of the electrolytes. For example, characterization can include electrical testing (e.g., resistance, capacitance, leakage, etc. measurements) and microscopy (e.g., atomic force microscopy (AFM), scanning electron microscopy (SEM), etc.). Once the efficacy of the electrolytes has been determined, one, two, or all of the electrolytes can be selected for further experimentation and evaluation or for production. Other electrochemical plating parameters can be testing in a similar fashion.

Die Mount

Figure 3B:
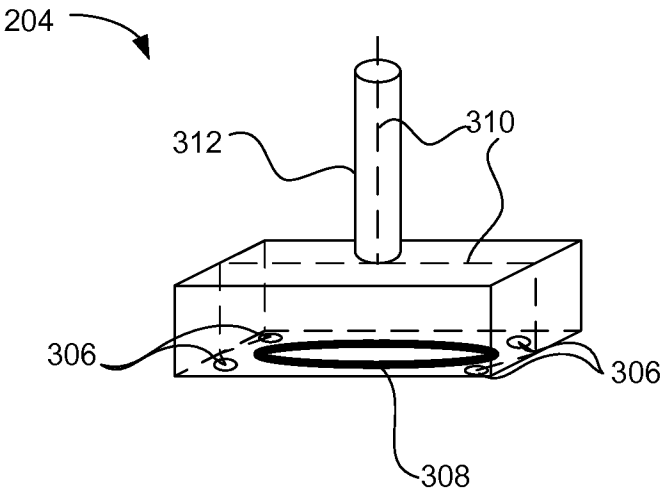
FIG. 3 illustrates a cross-sectional view of a die mount.
Figure 3A:
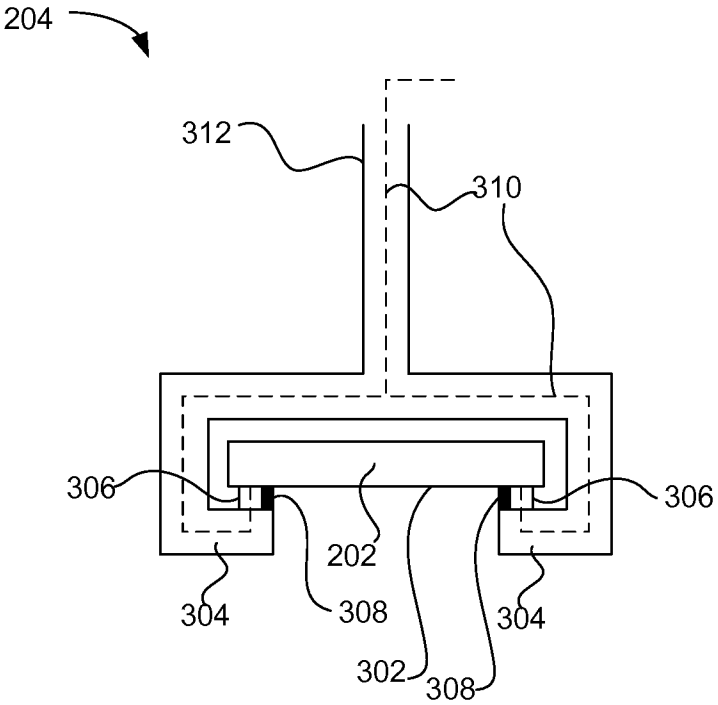

FIGS. 3A and 3B illustrate cross-sectional views of the die mount 204. The die mount 204 shown in FIGS. 3A and 3B is one way to implement the substrate 202 as a cathode. For example, the die mount 204 is implemented in such a way as to hold the substrate 202 in an inverted position such that the front surface 302 of the wafer is exposed to the electrolyte 206 and therefore is plated. It will be appreciated that various other techniques and/or designs can be used.

FIG. 3A shows a cross-sectional view of the die mount 204 with the substrate 202 in place. FIG. 3B shows a perspective view of the die mount 204 without the substrate 202 to show the extent of a retaining lip 304 used to retain the substrate 202 within the die mount 204. The die mount may be separable into multiple pieces to insert the substrate 202, or may include a slot or other device for accepting the substrate 202. If the die mount 204 is separable, the die mount 204 may include various seals to prevent the entry of liquid into the die mount 204.

The die mount 204 includes a retaining lip 304 that hold the substrate 202 above the anode 208. Although a retaining lip is shown, it is understood that various other retention devices can be used. The retaining lip 304 may also include or house contacts 306 that deliver current to the substrate 202. The retaining lip 304 may be connected to an o-ring 306 that is used to form a seal between the substrate 202 and the die mount 204, and therefore to prevent electrolyte 206 from entering the interior of the die mount 204. In this way, substantially only the front surface 302 of the substrate 202 is plated. Although an o-ring 306 is shown and described here, it is understood that any seal, such as a lip seal or a seal made from adhesive, can also be used.

Electric current travels from the potentiostat 210 through an electrical path 310 of the die mount 204, and into the substrate 202. For example, the electrical path 310 may be formed using copper wire or another conductive material. The die mount 204 may also have a stem 312 through which the electrical path 310 travels, and which is attached to a motor that rotates the die mount 204. The motor can also lower the die mount 204 and the substrate 202 into the electrolyte 206 and may be capable of adjusting the spacing between the electrodes (which may also be adjusted by moving the counter electrode).

Although one implementation of the die mount 204 is shown, it is understood that various other modifications and/or configurations are possible. For example, the substrate 202 can be positioned at any angle, the retaining lip 304 can have other configurations such as including retention devices to press the substrate 202 against the contacts 306, etc.

Figure 4:
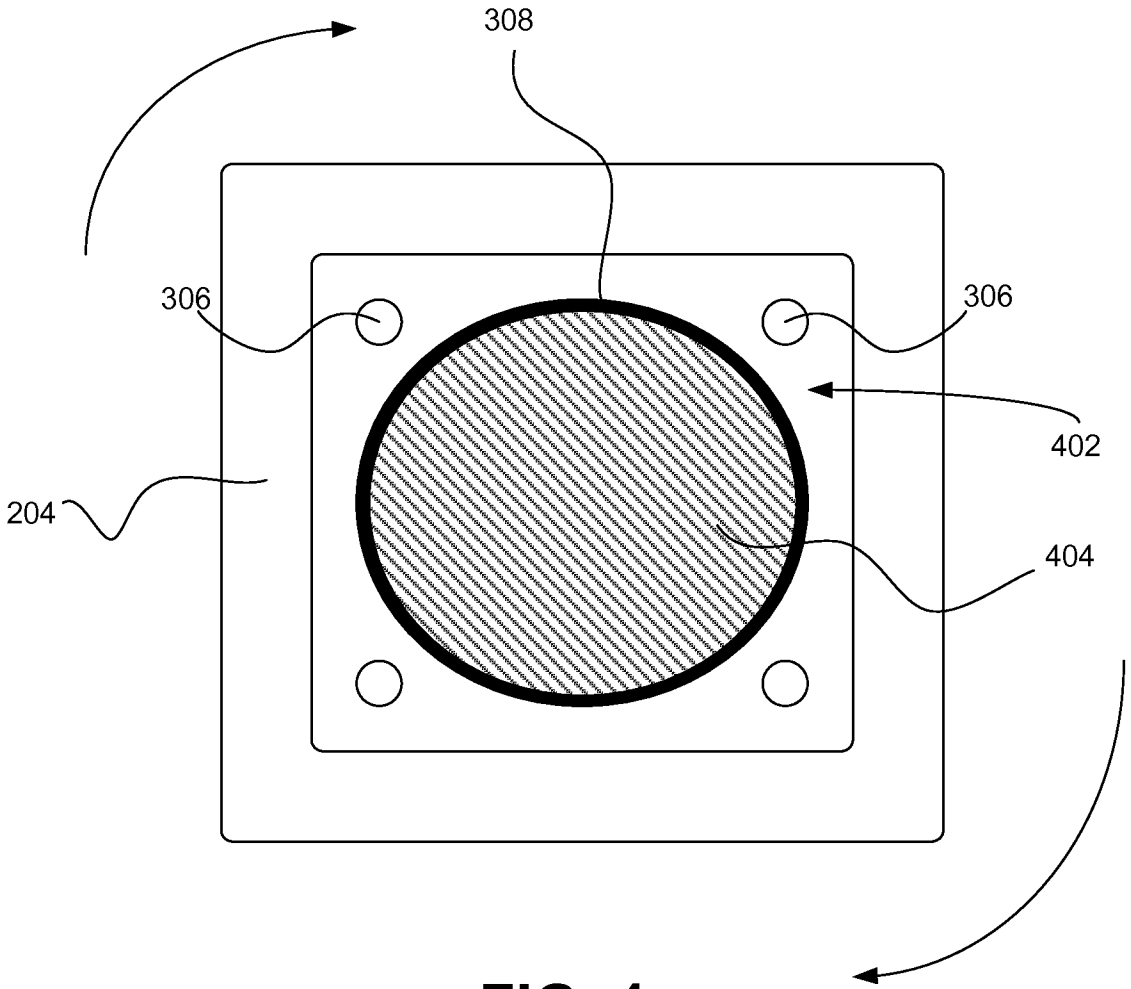
FIG. 4 illustrates a top view of the substrate in the die mount.

FIG. 4 illustrates a top view of the substrate 202 in the die mount 204. The substrate 202 includes an exposed area 402 (e.g., part of the front surface 302) that is sealed by the o-ring 308. The exposed area 402 is the portion of the substrate 202 to be electroplated, it may be covered by a seed layer 404 (if necessary) for electrochemical deposition. The o-ring 308 seals the die mount 204 to prevent electrolyte 206 from entering the die mount 204. The seed layer 404 may be, for example, a conductive layer such as copper or ruthenium that is deposited using a deposition process such as physical vapor deposition (PVD) or chemical vapor deposition (CVD).

The seed layer 404 provides a surface for the electrochemically deposited metal to attach to, and provides a conductive path over the front surface 302 of the substrate 202. When current (e.g., from the potentiostat 210) is applied to the die mount 204, it travels through the contacts 306 and conducts through the seed layer 404 and the exposed area 402. In this way, electrochemical deposition can be performed.

Process for Combinatorial Electrochemical Deposition

Figure 5:
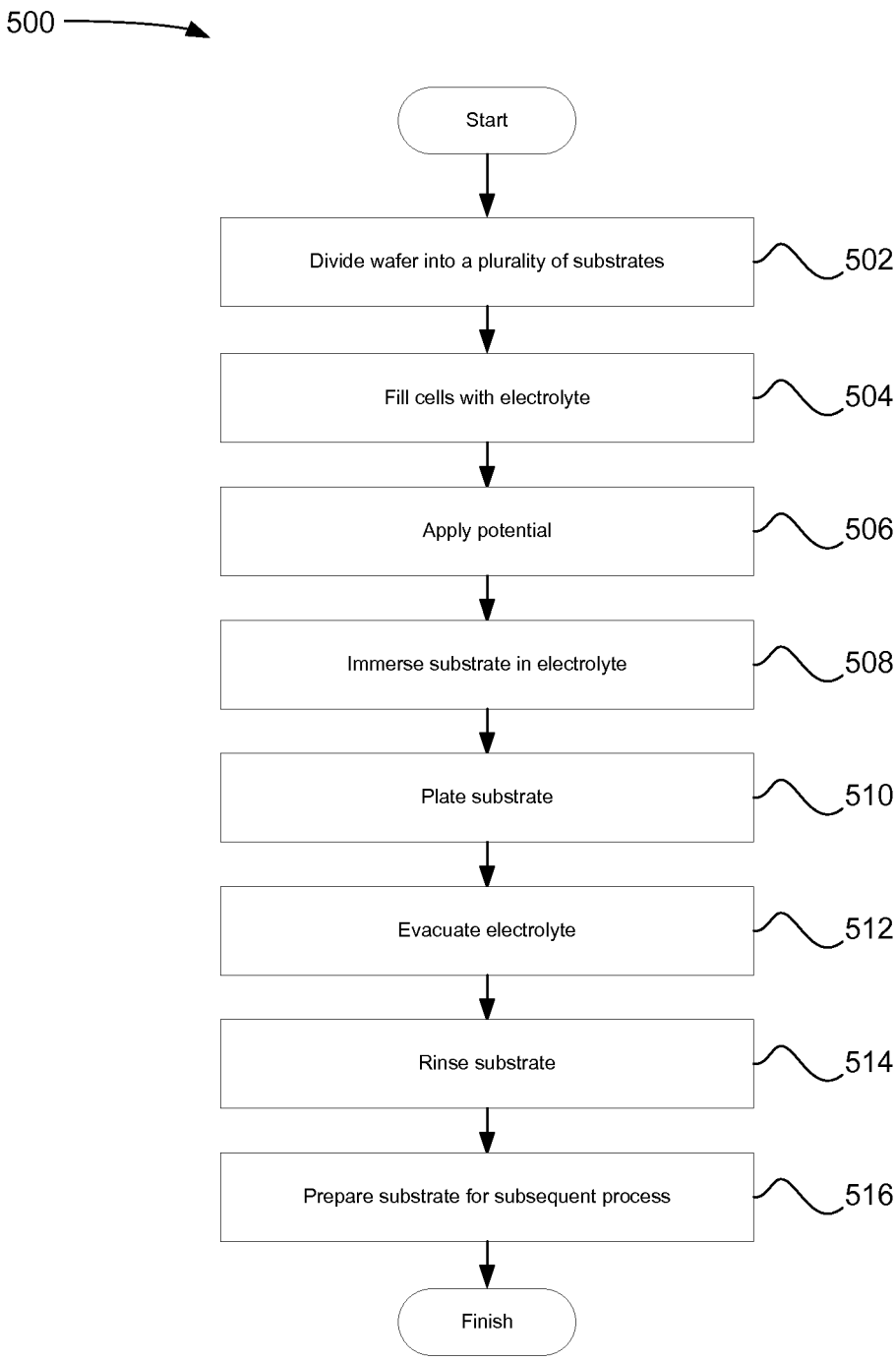
FIG. 5 is a flowchart describing a process for combinatorial electrochemical deposition.

FIG. 5 is a flowchart describing a process 500 for combinatorial electrochemical deposition.

In operation 502, a wafer is divided into a plurality of substrates 202 for combinatorial electrochemical processing. The wafer can be divided using any known technique including dicing the wafer. The resulting substrates 202 can include semiconductor structures (e.g., conductive lines, active components such as transistors, etc.) including a die, a portion of a die, or multiple dice. Alternatively, multiple substrates comprising wafer portions can be obtained from other sources. The wafers can be semiconductor wafers, solar panels, etc.

In operation 504, the cells 200 are filled with electrolyte 206. The electrolyte 206 may be chosen based on the metal to be deposited on the substrates 202. For example, to deposit a nickel layer on the substrate 202, an electrolyte 206 containing nickel ions can be chosen. The electrolytes 206 can be varied across multiple cells 200 for combinatorial processing. For example, two cells 200 may have one electrolyte, while two other cells 200 use a different electrolyte 206.

In operation 506, a potential is applied across the substrate 202 and the anode 208. As described above, the substrate 202 may be a portion of a wafer. In some embodiments, the substrate 202 is immersed in the electrolyte 206 (see operation 508) before the potential is applied.

In operation 508, the substrate 202 is immersed into the electrolyte 206. The substrate 202 is at least partially immersed in the electrolyte 206. The substrate 202 may be immersed by lowering the die mount 204 into the electrolyte 206, for example. The anode 208 is also be at least partially immersed in the electrolyte 206, and may be present in the electrolyte 206 before the substrate 202 is immersed in the electrolyte 206.

In operation 510, the substrate 202 is plated for a certain amount of time at a certain temperature. The plating can be performed by creating a potential across the substrate 202 and the anode 208 by applying a current using the potentiostat 210.

During the plating process, conditions of the plating can be varied across the cells 200. For example, two cells may use 100 mA/cm$^2$ of current density, while two other cells 200 use 200 mA/cm$^2$ of current density for plating. The resulting deposited layers can be compared to determine which current provides satisfactory results for the application. Various other characteristics, such as voltage, current density, substrate and/or anode rotation direction and/or speed, etc., can also be varied.

The plating process may include rotating the substrate 202 (e.g., the cathode) and/or the anode 208 to agitate the electrolyte 206. In one embodiment, the substrate 202 and the anode 208 can be rotated in the same direction. In another embodiment, the anode 208 could be counterrotated compared to the substrate 202. In this embodiment, the anode 208 and the substrate 202 may be brought into close enough vicinity (e.g., 5-7 mm) that when the anode 208 is counterrotated, the capillary forces and turbulent flow developed in the electrolyte is sufficient to retain the electrolyte within the space between the substrate 202 and the anode 208.

In other embodiments, other mass transport mechanisms can be used to agitate and move the electrolyte. Examples of such mechanisms include traditional stirring, ultra/mega/sonication, vibration, shaking, planetary rotation etc.

In operation 512, the electrolyte is evacuated from the cell 200. The electrolyte 206 may be drained out of the cell 200 once plating is finished. In operation 512, the substrate 202 is rinsed to remove any excess electrolyte.

In operation 516, the substrate is prepared for a subsequent process. For example, other combinatorial processes can be performed in the cell 200. Chemical mechanical polishing (CMP) can be performed in a combinatorial manner, for example, by replacing the anode 208 with a CMP pad. The substrate 202 could then be rotated to planarize the newly deposited layer.

Preparation for subsequent processes can include characterizing the substrates. For example, the substrates and the deposited layers can be examined using electrical testing, microscopy (e.g., scanning electron microscopy (SEM), transmission electron microscopy (TEM), atomic force microscopy (AFM) and other techniques to characterize the deposited layers and determine the efficacy of the processes used to deposit those layers. A subsequent process can then be a process of selecting processes for further evaluation.

Although the foregoing examples have been described in some detail for purposes of clarity of understanding, the invention is not limited to the details provided. There are many alternative ways of implementing the invention. The disclosed examples are illustrative and not restrictive.

What is claimed:

1. An apparatus comprising:

a plurality of die mounts, each die mount configured to hold a substrate, wherein the substrate is a diced portion of a wafer, wherein at least one of the die mounts is configured to rotate;

a plurality of counter electrodes, wherein each counter electrode is spaced from a die mount of the plurality of die mounts forming a plurality of electrochemical cells, wherein the counter electrodes spaced from the at least one of the die mounts are configured to rotate in opposite direction as compared to that of the at least one of the die mounts, wherein the space between the each counter electrode and the each die mount is configured to contain an electrolyte;

wherein the rotations and the spacing of the each die mount and the each counter electrode are configured to retain the electrolyte to the space between the each die mount and the each electrode without a cell wall;

wherein the plurality of die mounts and the plurality of counter electrodes are connected to a multichannel potentiostat configured to perform combinatorial electrochemical plating on the substrate held by each of the plurality of die mounts.

2. The apparatus of claim 1, wherein each of the plurality of die mounts comprises:

a retaining lip to hold the substrate;

contacts in the retaining lip to deliver current from the multichannel potentiostat; and a seal configured to prevent the electrolyte from entering an interior of the die mount.

3. The apparatus of claim 2, wherein the seal is one of an o-ring, a lip seal, or an adhesive.

4. The apparatus of claim 1, wherein the substrates mounted to the plurality of die mounts are diced from a same wafer.

5. An apparatus comprising:

a die mount, wherein the die mount is configured to hold a substrate, wherein the substrate is a diced portion of a wafer, wherein the die mount is configured to rotate;

a counter electrode, wherein the counter electrode is spaced from the die mount, wherein the counter electrode is configured to rotate in an opposite direction as compared to that of the die mount, wherein the die mount and the counter electrode form an electrochemical cell;

wherein the space between the counter electrode and the die mount is configured to contain an electrolyte;

wherein the rotations and the spacing of the die mount and the counter electrode are configured to retain the electrolyte to the space between the die mount and the electrode without a cell wall;

wherein the die mount and the counter electrode are connected to a multichannel potentiostat configured to perform combinatorial electrochemical plating on the substrate held by the die mount.

6. The apparatus of claim 5, wherein the die mount comprises:

a retaining lip to hold the substrate;

contacts in the retaining lip to deliver current from the multichannel potentiostat; and a seal configured to prevent the electrolyte from entering an interior of the die mount.

7. The apparatus of claim 6, wherein the seal is one of an o-ring, a lip seal, or an adhesive.

8. An apparatus comprising:

a plurality of electrochemical deposition cells, wherein each electrochemical deposition cell comprises a die mount and a counter electrode, wherein the die mount is configured to hold a substrate, wherein the substrate is a diced portion of a wafer, wherein the die mount is configured to rotate;

wherein the counter electrode is spaced from the die mount, wherein the counter electrode is configured to rotate in opposite direction as compared to that of the die mount, wherein the space between the counter electrode and the die mount is configured to contain an electrolyte;

wherein the rotations and the spacing of the die mount and the counter electrode are configured to retain the electrolyte to the space between the die mount and the electrode without a cell wall;

wherein the die mount and the counter electrode are connected to a multichannel potentiostat configured to perform combinatorial electrochemical plating on the substrate held by the die mount.

9. The apparatus of claim 8, wherein the die mount comprises:

a retaining lip to hold the substrate;

contacts in the retaining lip to deliver current from the multichannel potentiostat; and a seal configured to prevent the electrolyte from entering an interior of the die mount.

10. The apparatus of claim 9, wherein the seal is one of an o-ring, a lip seal, or an adhesive.

* * * * *